US005674051A

United States Patent [19]

Maruyama

[11] Patent Number: 5,674,051

[45] Date of Patent: Oct. 7, 1997

[54] POSITIVE DISPLACEMENT PUMP HAVING SYNCHRONOUSLY ROTATED NON-CIRCULAR ROTORS

[75] Inventor: Teruo Maruyama, Hirakata, Japan

[73] Assignee: Matsushita Electric Industrial Co., Ltd., Osaka-fu, Japan

[21] Appl. No.: 500,369

[22] Filed: Jul. 10, 1995

[30] Foreign Application Priority Data

Jul. 11, 1994 [JP] Japan ..... 6-158609

[51] Int. Cl.[6] ..... F04B 41/06

[52] U.S. Cl. ..... 417/3; 417/42; 417/423.4; 417/423.12; 418/201.1

[58] Field of Search ..... 417/1–3, 26, 42, 417/45, 199.1, 201, 203, 205, 423.4, 293, 423.12, 359, 360, 361; 418/201.1

[56] References Cited

U.S. PATENT DOCUMENTS 4,808,077 2/1989 Kan et al. ..... 417/2
5,197,861 3/1993 Maruyama et al. .
5,271,719 12/1993 Abe et al. ..... 417/26
5,302,089 4/1994 Maruyama et al. ..... 417/199.1
5,314,312 5/1994 Ikemoto et al. ..... 417/16
5,348,448 9/1994 Ikemoto et al. ..... 417/17
5,352,097 10/1994 Itou et al. ..... 417/42
5,354,179 10/1994 Maruyama et al. .

*Primary Examiner*—Timothy Thorpe
*Assistant Examiner*—Xuan M. Thai
*Attorney, Agent, or Firm*—Wenderoth, Lind & Ponack

[57] ABSTRACT

A positive displacement pump includes a plurality of rotors accommodated in a housing, each of the rotors having a non-circular sectional shape, bearings for supporting rotation of the rotors, a fluid inlet formed in the housing on its suction side and a fluid outlet formed in the housing on its discharge side, motors for independently rotating the plurality of rotors, and detecting devices for detecting a rotating angle and/or a rotation frequency of each of the rotors. While the plurality of rotors are controlled to be synchronously rotated basis on of signals from the detecting devices, a change of a volume of a space defined by the rotors and housing from the suction side to the discharge side is utilized to thereby draw in and discharge a fluid.

7 Claims, 7 Drawing Sheets

POSITIVE DISPLACEMENT PUMP HAVING SYNCHRONOUSLY ROTATED NON-CIRCULAR ROTORS

BACKGROUND OF THE INVENTION

The present invention relates to a vacuum pump or compressor to be used in manufacturing facilities for manufacturing semiconductors.

A vacuum pump is indispensable to for generating vacuum environment for (Chemical Vapor deposition) apparatuses, dry etching apparatuses, sputtering apparatuses, etc. in manufacturing semiconductors. Recent higher demands for the vacuum pump to be integrated and small for use in manufacturing processes of semiconductors are mainly intended to achieve a higher degree of vacuum and further cleanliness as well as to make the vacuum pump easy to maintain and compact.

In compliance with the above-described requirement for a vacuum discharge system of for use in semiconductor facilities, a roughing dry vacuum pump has been widely used in place of a conventionally used oil rotary pump to obtain a purer vacuum environment.

FIG. 11 shows a kind of a conventional positive displacement vacuum pump (roughing pump), namely, a thread groove-type (screw-type) dry vacuum pump, wherein 101 indicates a housing, similarly, 102 a first rotary shaft, 103 a second rotary shaft, 104 and 105 cylindrical rotors set on the respective rotary shafts 102 and 103, 106 and 107 thread grooves formed in outer peripheral parts of the rotors 104 and 105. In the conventional thread groove-type vacuum pump, the first and second rotary shafts 102 and 103 are set to be parallel to each other within the housing 101, having the rotors 104 and 105 supported thereon. A sealed space is generated when recessed parts (grooves) of the thread groove 106 (or 107) of the rotor 104 (or 105) are meshed with projecting parts (ridges) of the counterpart thread groove 107 (or 106) of the rotor 105 (or 104). In accordance with the rotation of the rotors 104 and 105, the sealed space is moved from a suction side to a discharge side, whereby suction and discharge operations are effected in the vacuum pump.

The two rotors 104 and 105 of the thread groove-type vacuum pump are synchronously rotated owing to timing gears 110*a* and 110*b*. More specifically, the rotation of a motor 108 is transmitted from a driving gear 109*a* to an intermediate gear 109*b* and therefrom to the timing gear 110*b* meshed with the other timing gear 110*a* of the rotor 104. Rotating phase angles of the rotors 104 and 105 are adjusted through the meshing of the timing gears 110*a* and 110*b*.

The above first rotary shaft 102 and second 25 rotary shaft 103 are supported by rolling bearings 113*a*, 113*b* and 114*a*, 114*b*, respectively. In order to lubricate the rolling bearings and gears, an oil 117 is supplied from an oil pan 116 at the lower part of an oil pump 115 built in at an end of the driving gear 109*b* to each part through an oil filter. In addition, the two rotary shafts 102 and 103 are formed hollow and equipped with stroke nozzles 118 and 119 at the lowest parts thereof to suction and feed the oil 117 to the rolling bearings in accordance with the rotation of the rotors, i.e., a self-suction effect is exerted by the hollow rotary shafts (not illustrated in the drawing).

A mechanical seal 121 is provided between an operating chamber where the rotors are accommodated and a chamber accommodating the bearings so as to prevent the oil from entering the chamber.

The screw-type dry vacuum pump, however has disadvantages. That is, many gears are needed for the purpose of transmission of power and synchronous rotation of rotors, and thus, the number of components is increased thereby to complicating the structure. Also, the synchronous rotation of rotors in a mechanical fashion, wherein a torque is transmitted from one rotor to the other rotor by using gears, hinders high-speed operation and makes the apparatus bulky in size, and the like.

In order to solve the above disadvantages inherent in the roughing dry vacuum pump, the inventor of the present invention has proposed an improved vacuum pump provided with a plurality of screw rotors driven by independent motors in U.S. Pat. Nos. 5,197,861 and 5,354,179. According to the inventor's proposal, the plurality of screw rotors are synchronously rotated in a contactless manner using a detecting means, e.g., a rotary encoder or the like detecting the rotating angle and rotation frequency of the rotors, and at the same time, the screw rotors are cantilevered in the same direction. Accordingly, the proposal provides a roughing vacuum pump which is clean and greatly reduced in size, provides, space-saving without the necessity of maintenance, and utilizes screw rotors which can rotate at high speeds. Moreover, if a high vacuum pump is set on a shaft of one of the rotors, the invention realizes an ultra-wide vacuum pump capable of achieving an ultra-high vacuum from the atmospheric pressure.

Meanwhile, when the proposed vacuum pump is applied to a manufacturing process for manufacturing semiconductors using a reactive gas, the following issues common to every kind of dry vacuum pump are still to be solved.

Since the dry pump (oil-free pump) does not use oil in the operating chamber, it has higher reliability than the oil rotary pump. On the other hand, the rotors, casing, etc. of the dry pump are directly exposed to an active gas or a reaction product, and therefore the dry pump may confront more severe conditions than the oil rotary pump. Aluminum plasma etching or a process to form a silicon nitride film is regarded as the most difficult task for the vacuum pump in the manufacture of semiconductors. While a lot of aluminum chloride ($AlCl_3$) and ammonium chloride ($NH_4CL$) are generated as reaction products, these substances are condensed to solids in the vacuum piping or pump of relatively low temperatures although they are in a gaseous state in the high-temperature and low-pressure reaction chamber. If the reaction products are accumulated in the vacuum pump, the products stick to the rotors and casing, obstructing the operation of the pump. For example, in a forming process for forming nitride films, the pump may not be driven after processing several batches.

The reaction products are more readily deposited at the thread grooves of the high-pressure discharge side in the thread groove-type dry pump. Although the dry pump is generally so constituted as to maintain a clearance of several tens of microns where the thread groove-type rotors are meshed or between the rotor and casing, if the reaction products are accumulated, for instance, inside the thread grooves, the vacuum pump of this kind that has no mechanism to discharge the deposits induces a mechanical contact of rotors and is rendered inoperable in a moment.

SUMMARY OF THE INVENTION

An object of the present invention is therefore to provide a positive displacement pump capable of easily removing reaction products from the inside of the pump.

Reaction products are easy to condense and deposit at a part of a high pressure inside the vacuum pump, namely, at a discharge side communicating with the air. At this time, how difficult it is to remove the deposited products (particles) is different even among the same type of pumps depending on basic mechanisms of the positive displacement pumps how to form a transfer space of fluid.

For instance, in the thread groove-type pump wherein a gap between the upper and lower surfaces of thread grooves of rotors meshed with each other (axial end faces of threads) is 0.05–0.1 mm at most, locking phenomenon is brought about if the products are accumulated in the gap, which leads the pump to an inoperable state.

In contrast, the products accumulated at a cylindrical face of a rotor are more easily sent out in comparison with those accumulated between the upper and lower surfaces of the thread grooves of rotors, because a cutting force impressed to the deposits from each rotor agrees in direction with a movement of the transferred fluid.

In accomplishing these and other objects, according to one aspect of the present invention, there is provided a positive displacement pump comprising:

a plurality of rotors accommodated in a housing, each of the rotors having a non-circular sectional shape;

bearings for supporting rotation of the rotors;

a fluid inlet formed in the housing on its suction side and a fluid outlet formed in the housing on its discharge side;

motors for independently rotating the plurality of rotors; and detecting means for detecting a rotating angle and/or a rotation frequency of each of the rotors, wherein, while the plurality of rotors are controlled to be synchronously rotated on a basis of signals from the detecting means, a change of a volume of a space defined by the rotors and housing from the suction side to the discharge side is utilized thereby to suck and discharge a fluid.

According to the present invention, a claw-type pump in the shape of, for example, a special, non-true circle is used at the discharge side of the positive displacement pump constituted of a plurality of rotors. The claw-type positive displacement pump sucks and discharges the fluid utilizing the change of the volume of the sealed space defined by the two rotors of the non-circular shape rotated in opposite directions and the housing such as a cocoon-shaped cylinder having a cocoon-shaped inner surface facing the rotors as shown in FIGS. 2A, 2B, and 2C. Products adhering to a wall surface in a radial direction of each rotor or an inner surface of the cylinder are relatively easily carried out in the claw-type pump by a shearing force applied in a circumferential direction to the products from each rotor. The two rotors are synchronously rotated by the two motors independently set to the shafts of corresponding rotors and detecting means for detecting the rotating angles and angular velocities of the rotors, and therefore the rotation frequency of each shaft is increased ten times the conventional limit of several thousands rpm. In order to increase a compression ratio, it is necessary in a conventional claw-type vacuum pump to provide multistage (e.g., four or more stages) rotors of a non-circular shape in the axial direction in estimation of an internal leak. On the other hand, according to the present invention, the rotation frequency is greatly increased, so that the internal leak per stage of the rotor is decreased. Accordingly, the number of rotors to obtain the same compression ratio (ultimate pressure) is reduced and the pump is made compact.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
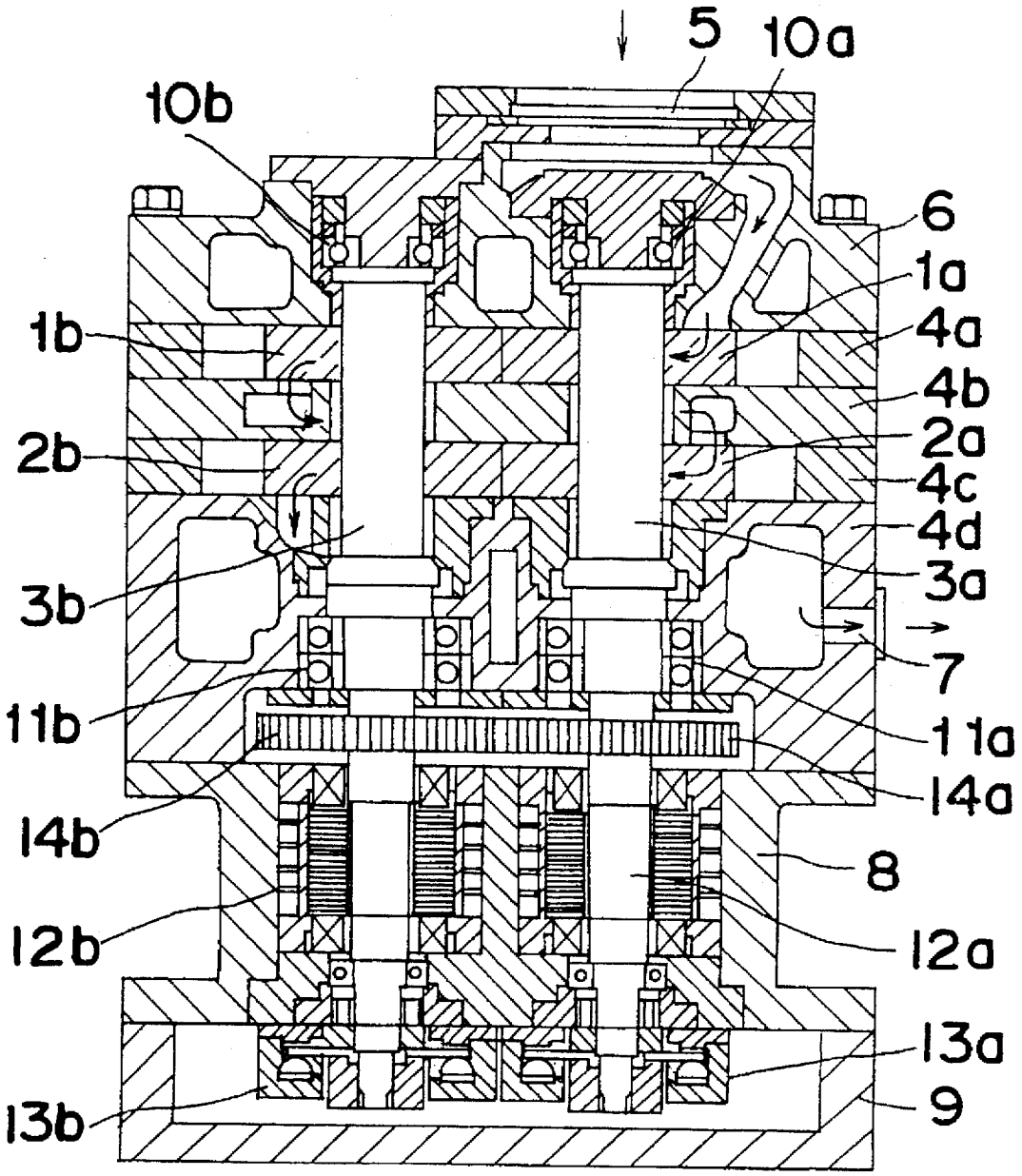
FIG. 1 is a front sectional view of a positive displacement pump according to a first embodiment of the present invention.

Before the description of the present invention proceeds, it is to be noted that like parts are designated by like reference numerals throughout the accompanying drawings.

A first embodiment of the present invention will be described with reference to FIG. 1.

In FIG. 1, rotors of a special shape (claw-type rotors) 1*a*, 1*b* and 2*a*, 2*b*, each of which is not a screw-type rotor and which has a non-circular section, are housed in housings 4*a*–4*d*. An inlet 5 is opened in an upper housing 6, while air is discharged out from the housing 6 through an outlet 7. AC servo motors 12*a*, 12*b* and encoders 13*a*, 13*b* for detecting rotating angles and angular velocities of the rotors 1*a*, 2*a* and 1*b*, 2*b* are respectively accommodated in housings 8 and 9. Rotary shafts 3*a* and 3*b* of the rotors 1*a*, 2*a* and 1*b*, 2*b* are supported by rolling bearings 10*a*, 11*a* and 10*b*, 11*b* which, as shown in FIG. 1, are radial bearings.

Figure 2A:
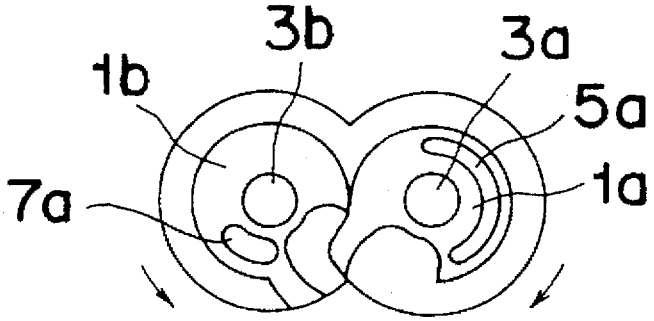
FIGS. 2A, 2B, and 2C are diagrams of an operation principle of a claw-type pump applied in the first embodiment of the present invention.
Figure 2B:
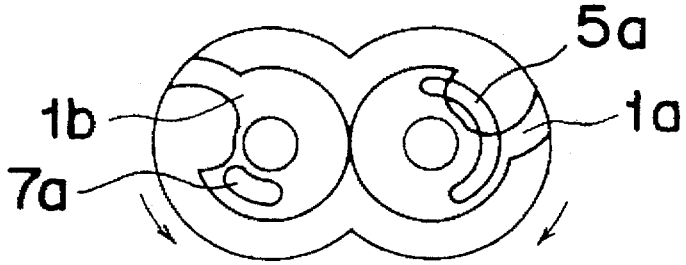
Figure 2C:
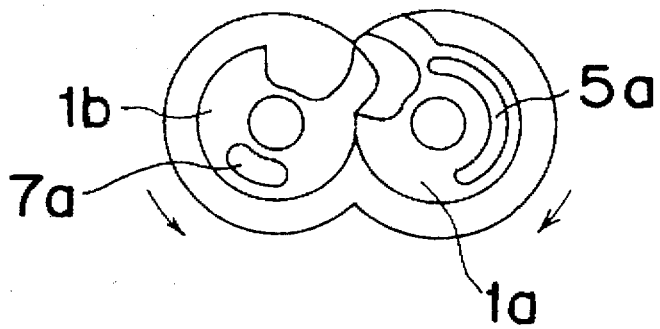

In the constitution shown in FIG. 1, the rotors 1*a*, 1*b* and 2*a*, 2*b* meshed with each other form a sealed space together with the housings 4*a*–4*d*. That is, such a sealed space is defined by the rotors and the inner surfaces of the housings with a small gap (e.g. as small as several hundreds of microns) formed between the rotors. The sealed space is transferred from the suction side to the discharge side to change a volume of the space in correspondence with the rotation of the rotors to thereby draw and discharge a fluid. When the sealed space is moved from a side of the inlet 5 to a side of the outlet 7 in accordance with the rotation of the rotors 1*a*, 1*b* and 2*a*, 2*b* in opposite directions, a positive displacement vacuum pump of the embodiment is realized. An operation principle of the pump is indicated in FIGS. 2A–2C wherein it is shown that the fluid is drawn in through a suction opening 5*a* connecting to the inlet 5 and discharged from a discharge opening 7*a* connecting to the outlet 7.

Contact-prevention gears 14*a* and 14*b* for preventing any contact of the rotors are provided at the lowest ends of the bearings 11*a* and 11*b*. A backlash where the gears 14*a* and 14*b* are meshed with each other is set to be smaller than a backlash between the rotors. Therefore, when the rotary shafts 3*a*, 3*b* are smoothly synchronously rotated, the prevention gears 14*a*, 14*b* are never brought in touch with each other in the embodiment. However, it is so constructed that once the synchronous rotation is broken, the contact-prevention gears 14 and 14*b* come into touch with each other prior to the contact of the rotors, to thereby prevent the collision of the rotors. Although the prevention gears 14*a*, 14*b* may be so constructed as to perform the above operation, the prevention gears 14*a*, 14*b* may be so constructed as to contact with each other at a small pressure. The prevention gears 14*a*, 14*b* are so arranged to prevent the two rotors from contacting with each other. It is preferable that the prevention gears 14*a*, 14*b* rotate in a contactless manner. As long as the prevention gears 14*a*, 14*b* contact with each other to the extent that the gears are not damaged, the high speed operation can be performed in comparison with the conventional pump.

The rotors are rotated at high speeds, i.e., several tens of thousands of times by the AC servo motors 12*a*, 12*b* independently provided at the lower parts of the rotary shafts 3*a*, 3*b*. In the first embodiment, the two rotary shafts 3*a*, 3*b* are subject to a PLL synchronous control in a manner as follows. An output pulse from each of the rotary encoders 13*a*, 13*b* at the lowest ends of the rotary shafts 3*a*, 3*b* as shown in FIG. 1 is compared with an instruction pulse (target value) set for a virtual rotor and then, a deviation of the output (rotation frequency, rotating angle) of each rotary shaft from the target value is operated at a phase difference counter, whereby the rotation of the servo motor of each shaft is controlled to remove the deviation.

According to the first embodiment, since the pump is so constructed by a composite pump combining the two rotors, an eccentric loading is generated in a radial direction of each rotary shaft. In order to receive such loadings, there are provided the two rolling bearings 10*a*, 11*a* and 10*b*, 11*b* at the upper and lower sides of the rotary shafts so that the upper and lower ends of each rotary shaft are rotatably supported by the rolling bearings.

Figure 3:
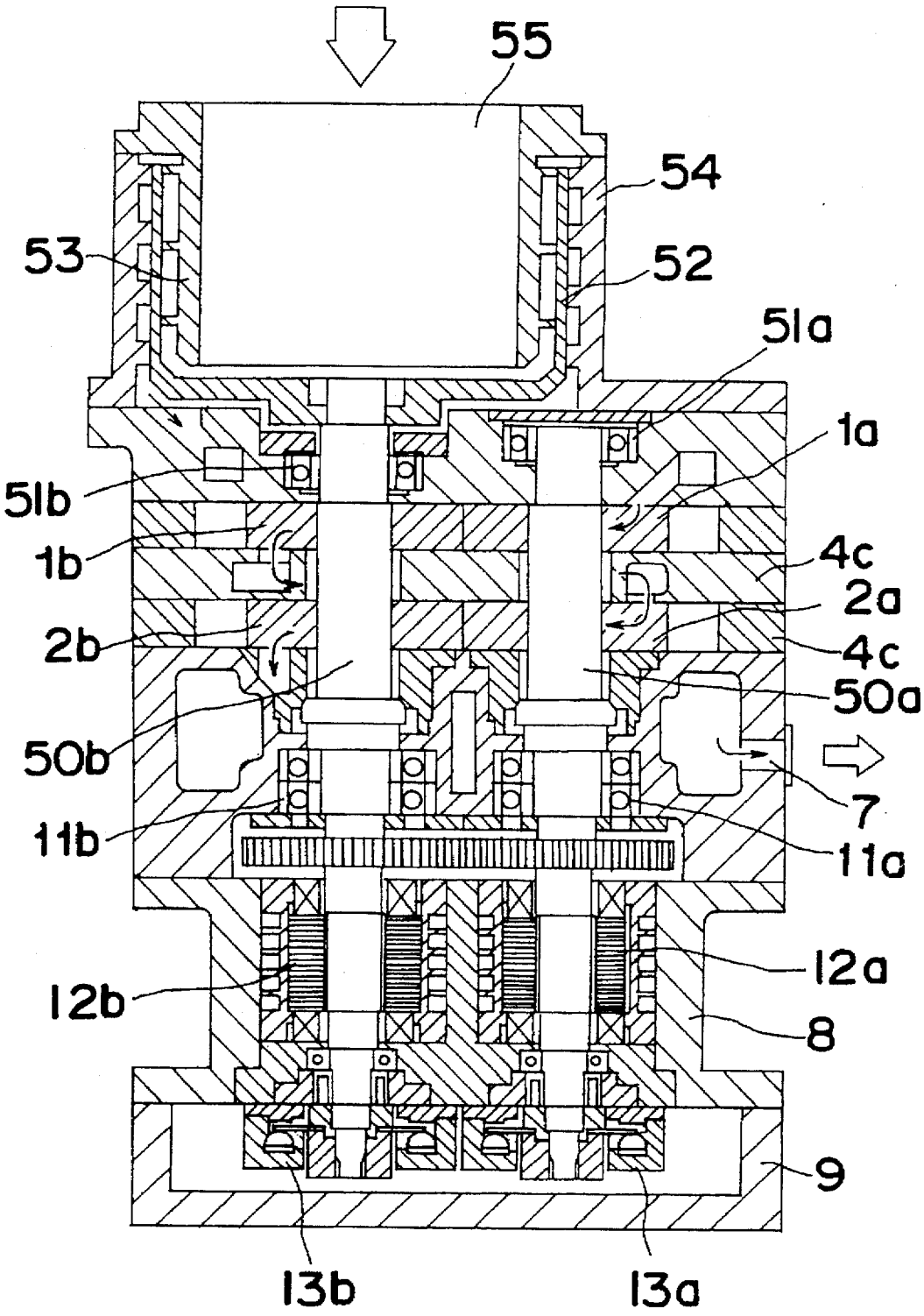
FIG. 3 is a front sectional view of a positive displacement pump according to a second embodiment of the present invention.

FIG. 3 indicates a second embodiment of the present invention, in which reference numerals; 50*a*, 50*b* indicate rotary shafts; 51*a*, 51*b* upper bearings for supporting the rotary shafts 50*a*, 50*b*; 52 a rotary cylindrical part of a high vacuum pump formed on an axis of one rotary shaft 50*b*; 53, 54 cylindrical sleeves with drag grooves arranged in the inner and outer peripheral surfaces of the rotary cylindrical part 52; and 55 an inlet.

The second embodiment realizes a wide-region vacuum pump which can reach an ultra-high vacuum approximately in the vicinity of $10^{-8}$ Torr from the approximately pressure all at once.

Figure 4:
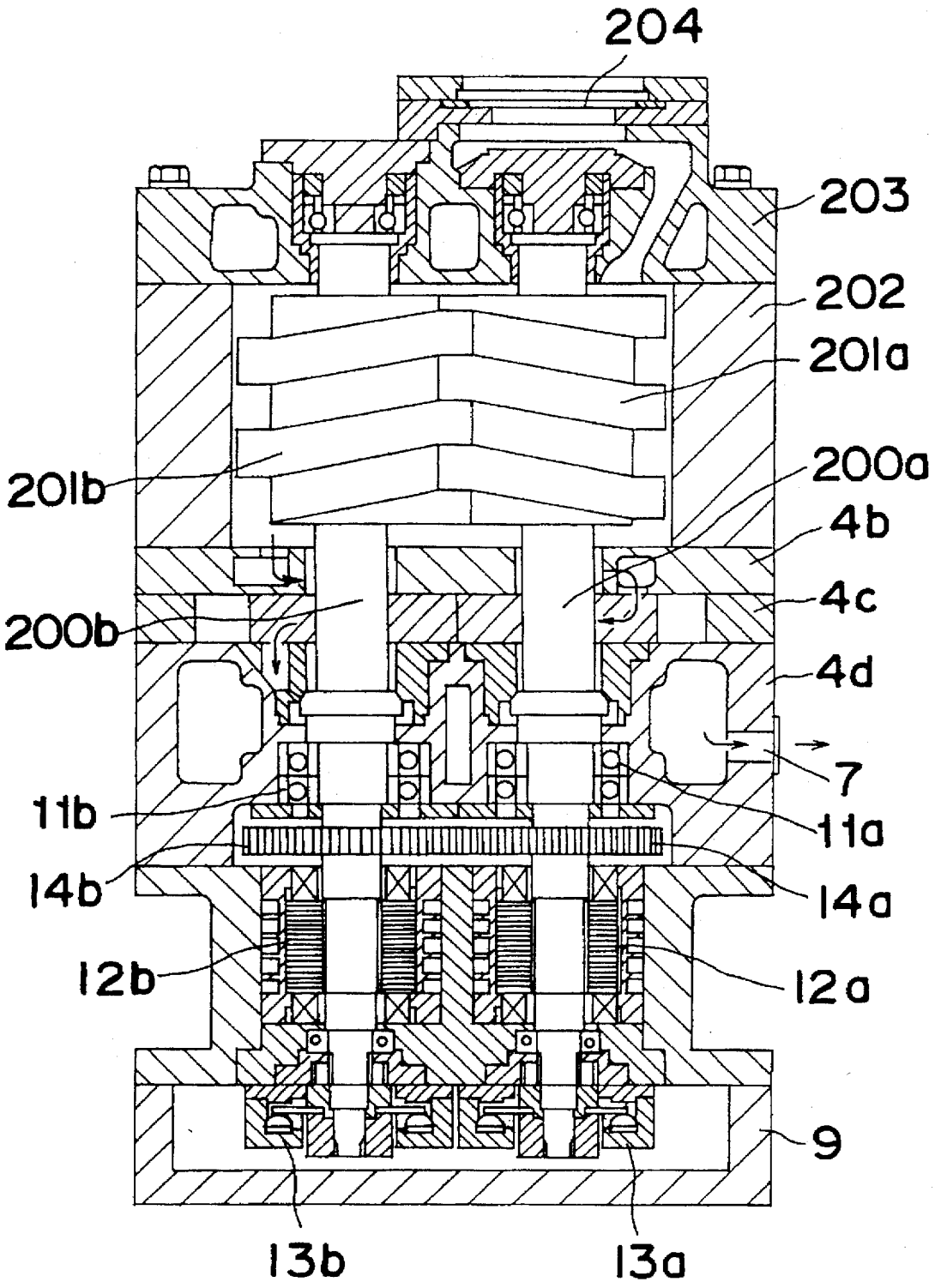
FIG. 4 is a front sectional view of a positive displacement pump according to a third embodiment of the present invention.

FIG. 4 is shows a third embodiment of the present invention wherein a roughing vacuum pump part is in a composite structure of a screw pump and a claw-type pump. More specifically, a claw-type pump is used at a discharge side where a reactive gas tends to gather and a screw-type (thread groove-type) pump is provided at a suction side so as to more easily reach a high ultimate pressure. In the configuration, features of the two different pumps are utilized. Reference numerals 200*a*, 200*b* are rotary shafts, 201*a*, 201*b* are screws, 202, 203 housings and 204 an inlet.

While a magnetic encoder such as a resolver or a general optical encoder may be used as the encoders 13*a*, 13*b* in the embodiment, a laser encoder applying the diffraction and interference of laser beams with a high resolution and high-speed response characteristic is employed in the foregoing embodiments.

Figure 5:
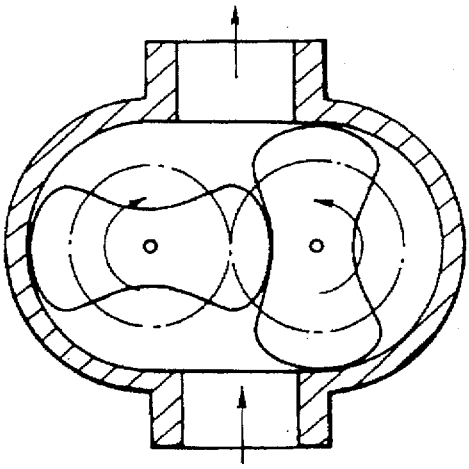
FIG. 5 is a front sectional view of a pump applicable to the present invention.
Figure 8:
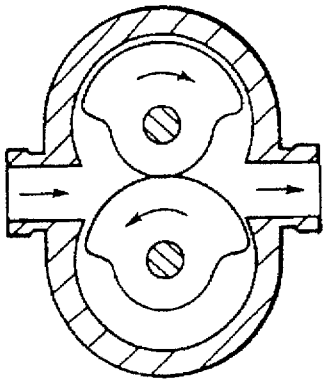
FIG.8 is a front sectional view of a pump applicable to the present invention.
Figure 6:
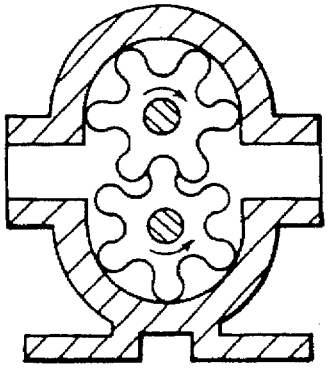
FIG. 6 is a front sectional view of a pump applicable to the present invention.
Figure 10:
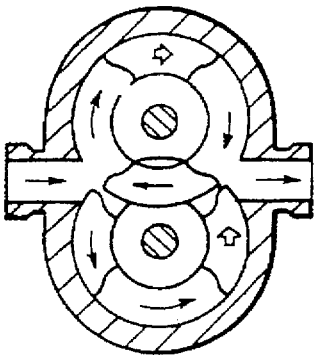
FIG. 10 is a front sectional view of a pump applicable to the present invention.
Figure 7:
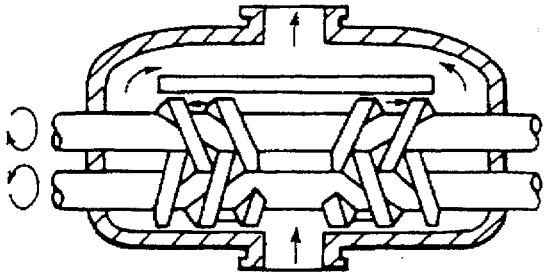
FIG. 7 is a front sectional view of a pump applicable to the present invention.
Figure 9A:
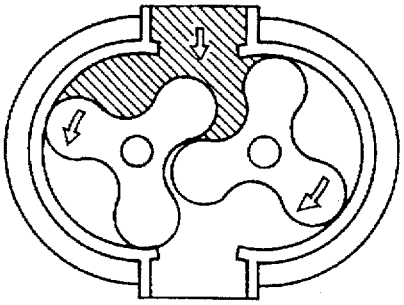
FIGS. 9A, 9B, 9C, and 9D are front sectional views of a multistage Roots type dry pump applicable to the present invention.
Figure 9C:
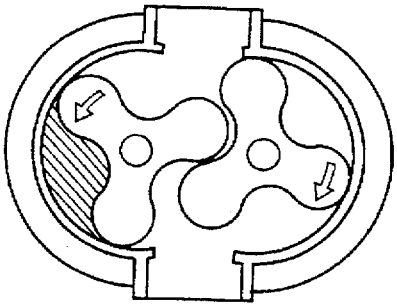
Figure 9B:
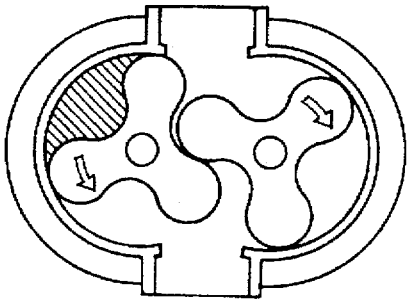
Figure 9D:
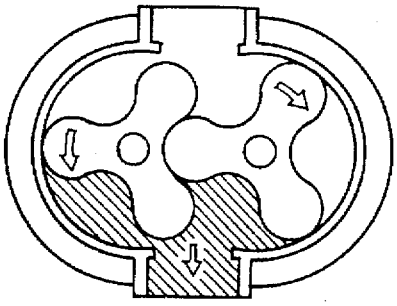
Figure 11:
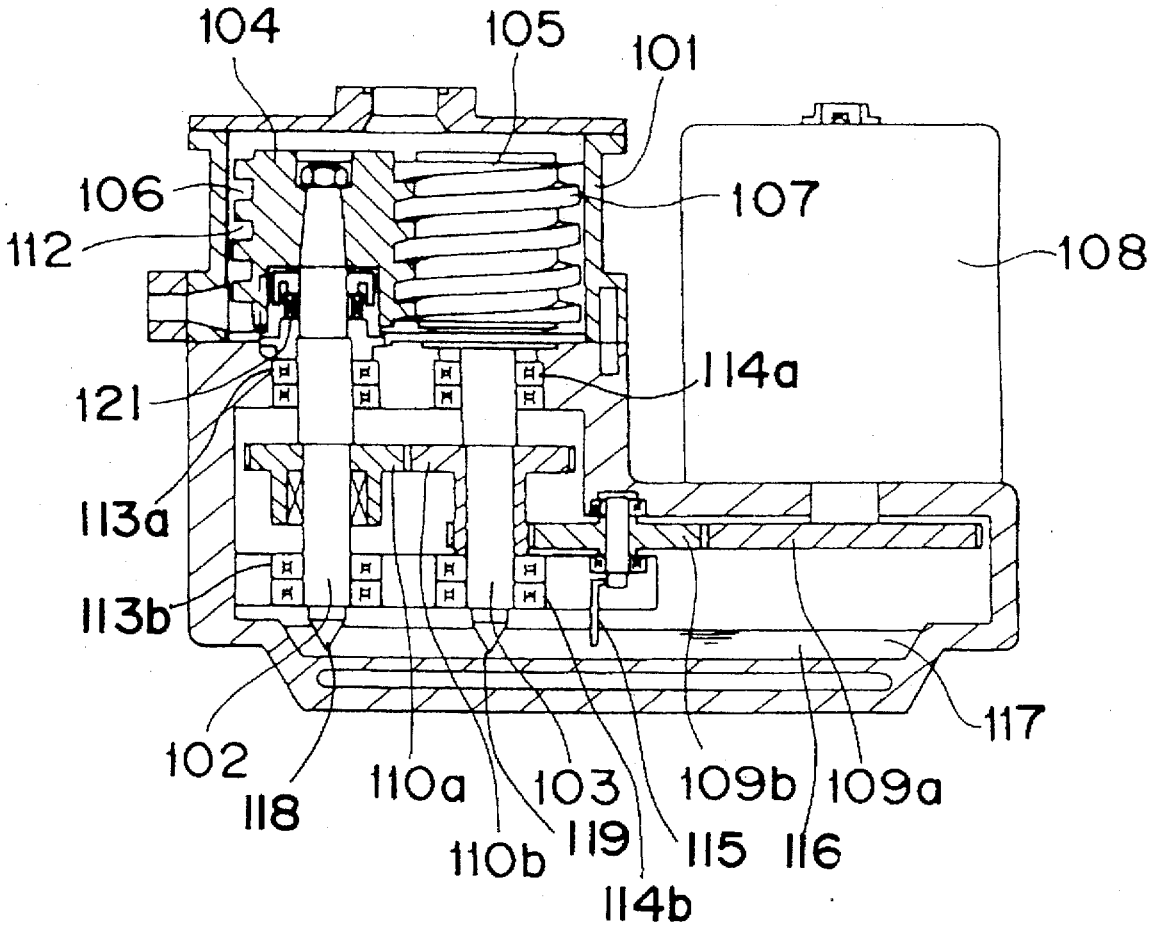
Fig. 11 PRIOR ART
FIG. 11 is a front sectional view of a conventional screw pump.

When the fluid rotating apparatus according to the embodiment is applied to an air-conditioning compressor or the like, the rotors part (corresponding to the rotors 1*a*, 1*b*, 2*a*, 2*b* in FIG. 1) may be of a Roots type in FIG. 5, a gear type in FIG. 6, a single lobe type as shown in FIG. 8, a double lobe type as shown in FIG. 10, a screw type as shown in FIG. 7, a multistage Roots type dry pump as shown in FIGS. 9A–9D, etc. In other words, the rotors may have the same sectional shape as shown in the first embodiment but, or, the rotors may have a the similar sectional shape.

The vacuum pump of the present invention shows sufficient reliability in a process handling a reactive gas. Since the vacuum pump is based on the synchronous rotation of rotors through electronic control as has already been proposed, for example, as described in detail in U.S. Pat. Nos. 5,197,861 and 5,354,179, the disclosures of which are hereby incorporated by reference, the vacuum pump is also advantageously compact, and space-saving and allows produces less.

Further, when a kinetic vacuum pump is set on the same axis as at least one rotor, a composite-type wide-region vacuum pump which can attain a high degree of vacuum of not higher than $10^{-8}$ Torr from the atmospheric pressure is realized.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A positive displacement pump comprising:

a housing having a suction side and a discharge side;

first and second rotors accommodated in said housing, each of said rotors having a non-circular sectional shape;

first and second rotor shafts rotatably supported within said housing, said rotors being supported by said rotor shafts, respectively;

first and second pairs of bearings disposed in said housing, each pair of said bearings including a first bearing supporting one of said rotor shafts at a first end thereof and a second bearing supporting said rotor shafts at a second end thereof opposite said first end, such that said first rotor is disposed between the bearings of said first pair of bearings and said second rotor is disposed between the bearings of said second pair of bearings;

a fluid inlet formed in said housing on said suction side, and a fluid outlet formed in said housing on said discharge side;

motors for independently rotating the plurality of rotors; and a detector for detecting a rotating angle and/or a rotation frequency of each of said rotors;

wherein said rotors are controlled to be synchronously rotated based on signals from said detector, and a change of volume of a space defined by said rotors and said housing from said suction side to said discharge side is utilized to cause suction and discharge of a fluid.

2. The positive displacement pump as claimed in claim 1, wherein said rotors have identical sectional shapes.

3. The positive displacement pump as claimed in claim 1, wherein said rotors have similar sectional shapes.

4. The positive displacement pump as claimed in claim 1, wherein said housing has an inner surface which faces said rotors, and said inner surface has a cocoon shape.

5. The positive displacement pump as claimed in claim 1, wherein said bearings comprise rolling bearings.

6. The positive displacement pump as claimed in claim 5, wherein said rolling bearings comprise radial bearings.

7. The positive displacement pump as claimed in claim 1, wherein said bearings comprise radial bearings.

* * * * *